US006427334B2

(12) United States Patent
Onion

(10) Patent No.: US 6,427,334 B2
(45) Date of Patent: Aug. 6, 2002

(54) FOLDING KNIFE WITH BLADE LOCKING MECHANISM

(76) Inventor: Kenneth J. Onion, 91-990 Oaniani St., Kapolei, HI (US) 96707

( * ) Notice: Subject to any disclaimer, the term of this patent is extended or adjusted under 35 U.S.C. 154(b) by 0 days.

(21) Appl. No.: 09/750,235

(22) Filed: Mar. 5, 2001

Related U.S. Application Data

(60) Provisional application No. 60/173,233, filed on Dec. 28, 1999.

(51) Int. Cl.[7] ..... B26B 1/04
(52) U.S. Cl. ..... 30/161; 30/162
(58) Field of Search ..... 30/160, 161, 155

(56) References Cited

U.S. PATENT DOCUMENTS

| | | | | |
|---|---|---|---|---|
| 1,743,022 | A | | 1/1930 | Carman |
| 3,868,774 | A | | 3/1975 | Miori ..... 30/161 |
| 4,040,181 | A | | 8/1977 | Johnson |
| 4,133,106 | A | | 1/1979 | Addis |
| 4,218,819 | A | | 8/1980 | Phelps |
| 4,268,960 | A | | 5/1981 | Reinschreiber |
| 4,570,341 | A | | 2/1986 | Konneker |
| 4,805,303 | A | | 2/1989 | Gibbs |
| 4,811,486 | A | | 3/1989 | Cunningham |
| 4,837,932 | A | | 6/1989 | Elsener |
| 4,947,552 | A | | 8/1990 | Barnes |
| 4,974,323 | A | | 12/1990 | Cassady |
| 5,044,079 | A | | 9/1991 | Gibbs |
| 5,092,045 | A | | 3/1992 | Boyd et al. |
| 5,095,624 | A | | 3/1992 | Ennis |
| 5,331,741 | A | | 7/1994 | Taylor |
| 5,502,895 | A | | 4/1996 | Lemaire |
| 5,511,310 | A | | 4/1996 | Sessions et al. |
| 5,515,610 | A | | 5/1996 | Levin et al. |
| D377,744 | S | | 2/1997 | Hasegawa |
| 5,615,484 | A | * | 4/1997 | Pittman ..... 30/161 |
| 5,647,129 | A | | 7/1997 | Stamper |
| 5,692,304 | A | | 12/1997 | Campbell |
| 5,755,035 | A | | 5/1998 | Weatherly |
| 5,802,722 | A | | 9/1998 | Maxey et al. |
| 5,815,927 | A | | 10/1998 | Collins |
| 5,826,340 | A | | 10/1998 | Hull |
| 5,887,347 | A | | 3/1999 | Gibbs |
| 6,122,829 | A | | 9/2000 | McHenry et al. |
| 6,125,543 | A | | 10/2000 | Jhones |
| 6,158,127 | A | | 12/2000 | Taylor |

FOREIGN PATENT DOCUMENTS

| | | |
|---|---|---|
| DE | 1104386 | 4/1961 |
| FR | 1069862 | 7/1954 |

* cited by examiner

*Primary Examiner*—Douglas D. Watts
(74) *Attorney, Agent, or Firm*—Kolisch Hartwell Dikcinson McCormack & Heuser

(57) ABSTRACT

A folding knife having a blade pivotally connected to an end of a handle so that the blade is rotatable about a pivot axis between an open position and a closed position. In the open position, the blade is extended away from the handle. In the closed position, the blade is at least partially received within the handle. The knife also has a locking mechanism that is movably secured to the handle so that it may be moved into a locking position. When in the locking position, the locking mechanism blocks a protruding member extending transversely outward from a surface of the blade to prevent the blade from being rotated from the open position to the closed position.

32 Claims, 6 Drawing Sheets

FOLDING KNIFE WITH BLADE LOCKING MECHANISM

This Application claims benefit of Prov. No. 60/173,233 filed Dec. 28, 1999.

BACKGROUND AND SUMMARY OF THE INVENTION

The present invention relates generally to knives, and more particularly to folding knives capable of being locked in an open position. Folding knives with various types of locking mechanisms are shown in U.S. Pat. Nos. 1,189,005, 1,454,665, 4,040,181, 4,240,201, 4,274,200, 4,404,748, 4,451,982, 4,502,221, 4,670,984, 4,805,303, 4,811,486, 4,837,932, 4,974,323, 4,979,301, 5,044,079, 5,060,379, 5,111,581, 5,293,690, 5,400,509, 5,425,175, 5,461,786, 5,515,610, 5,537,750, 5,689,885, 5,692,304, 5,737,841, 5,822,866, and 5,887,347, and in British Patent No. 3,490. U.S. Pat. Nos. 1,454,665, 4,274,200, 4,451,982, 5,111,581, 5,425,175, 5,737,841, and 5,822,866 are herein incorporated by reference. These patents disclose locking mechanisms where a blade is locked or held in place using a sliding-style locking device.

The present invention is a folding knife having a blade locking mechanism movably secured to the handle, so that the locking mechanism may be moved into a locking position. In the locking position, the locking mechanism blocks a protruding member extending transversely outward from the blade surface to lock the blade in an open position. This may be accomplished by providing a movable latch on the end of the knife handle, and biasing the latch into an extended position, in which it prevents blade rotation by obstructing a post secured to the blade. The latch may be configured in an exposed location on the knife handle so that the blade may be unlocked and moved to the closed position using one hand. In addition to assisting the locking function, the post may be configured to enable easy, one-handed opening of the blade.

DETAILED DESCRIPTION OF THE INVENTION

Figure 1:
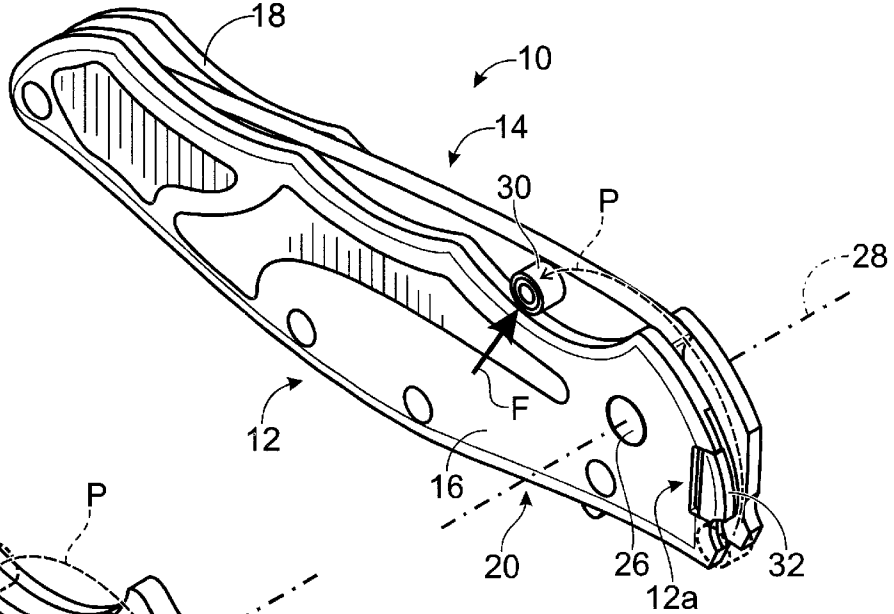
FIG. 1 is an isometric view of a knife according to the present invention, depicting the blade in a closed position.
Figure 2:
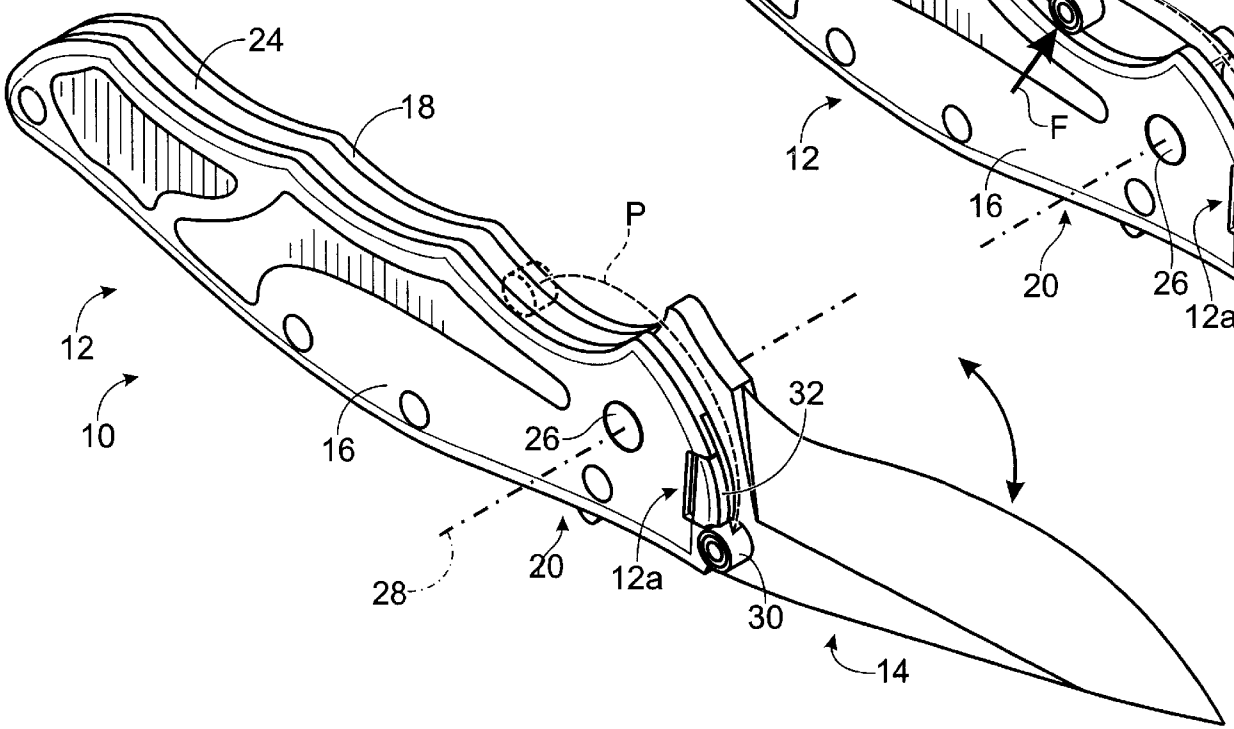
FIG. 2 is an isometric view of the knife shown in FIG. 1, depicting the blade as locked in an open position.
Figure 4:
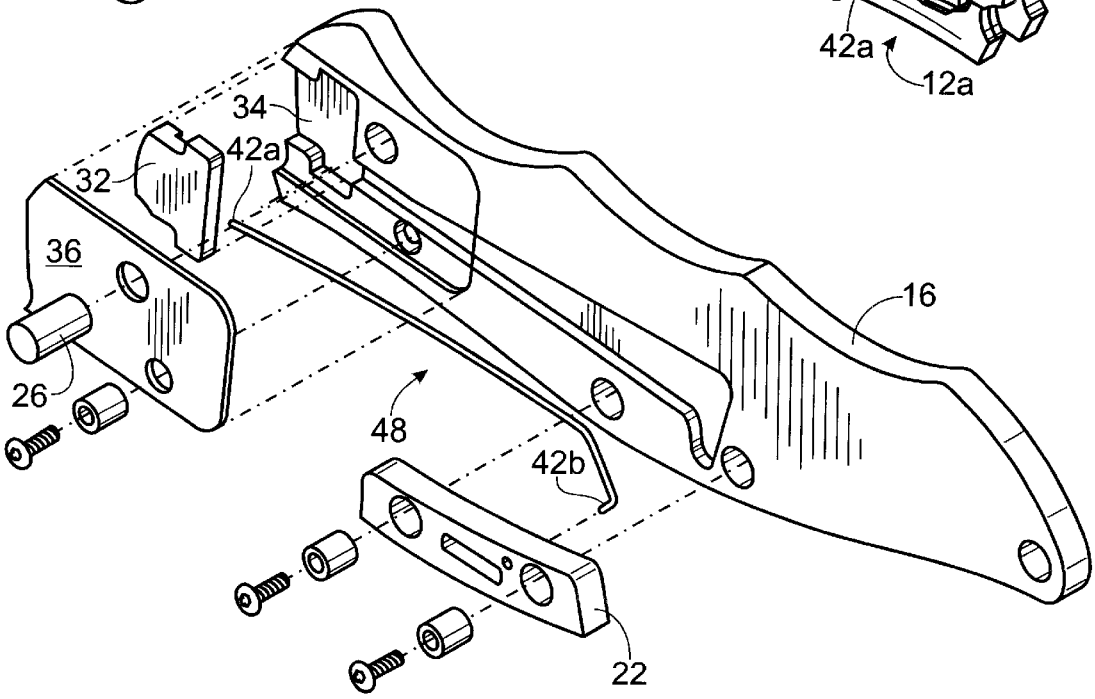
FIG. 4 is an exploded, isometric view of portions of the knife shown in FIG. 1.

Referring to the drawings, and more specifically to FIGS. 1 and 2, a folding knife 10 according to the present invention is shown, including handle 12 and folding blade 14. Handle 12 includes a pair of side members such as sideplates 16 and 18, which are separated at back portion 20 of handle 12 by a spacer such as backstrap 22 (FIG. 4). Handle 12 defines a blade-receiving channel 24 between sideplates 16 and 18. The tang of blade 14 is pivotally attached to handle end 12*a* by a pintle or pivot shaft 26, enabling blade 14 to pivot about pivot axis 28 between a closed position and an open position. In the closed position, blade 14 is at least partially received within blade-receiving channel 24, as shown in FIG. 1. FIG. 2 depicts the blade in the open position, in which it extends away from handle 12.

A protruding member such as a post or thumbstud 30 may be secured to blade 14. Typically, post 30 is cylindrically shaped and extends transversely to blade 14 from one or both of the broad flat sides of the blade. When provided on both sides of the blade, post 30 may include two separate post portions (one for each side of the blade), or a single unitary post may be disposed through a hole formed in the blade. Post 30 typically is spaced from pivot axis 28, so that the post defines an arcuate path of travel P centered about the pivot axis when the blade is rotated between the open and closed positions respectively depicted in FIGS. 1 and 2. The post and blade typically are configured so that the post is exposed and accessible for at least a portion of the blade's pivotal travel between the closed and open positions. Preferably, the post is exposed through the whole range of pivotal travel, to enable a user to selectively move the blade by applying force to the post.

Figure 12:
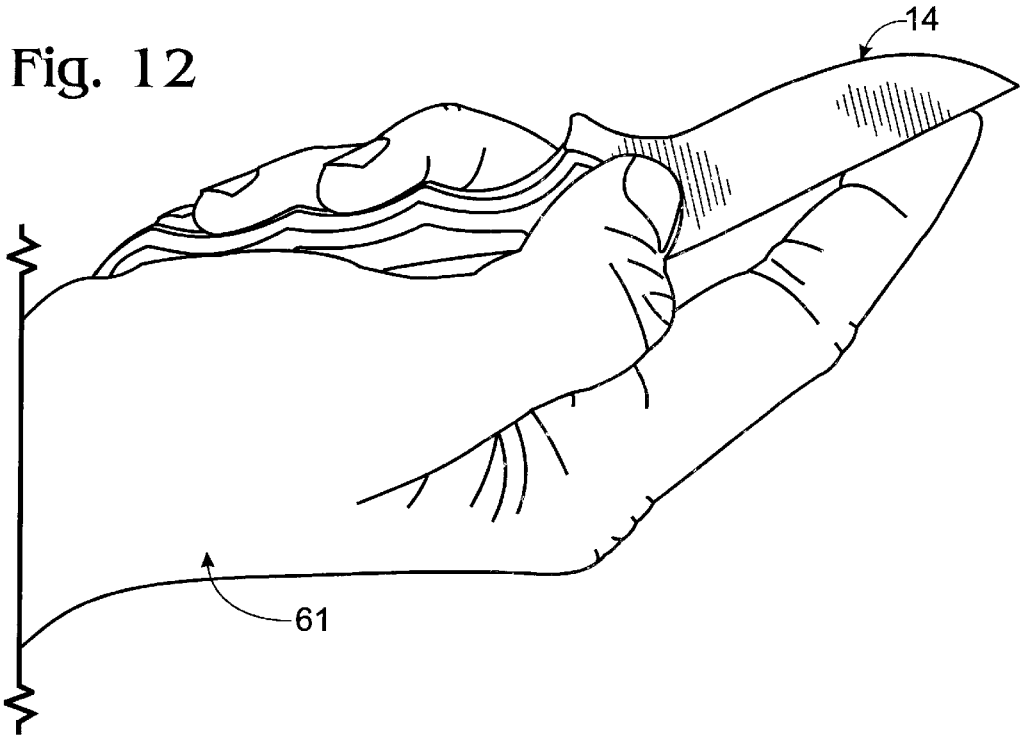
FIG. 12 is a view depicting a user's hand retracting a blade locking mechanism according to the present invention, in order to unlock the blade.

Post 30 performs a locking function, which will be explained in detail below, and enables a user of knife 10 to easily move the blade between the open and closed positions. Referring to FIG. 1, the exposed configuration of post 30 allows a user to perform a one-handed opening operation by simply applying an outward-directed force F to the post. When knife 10 is held with back 20 of the knife cradled in the palm of the hand, the thumb of the hand may be used to exert force F and cause the blade to rotate toward the open position shown in FIG. 2. This opening motion is also illustrated in FIG. 12. Rotating force may also be applied to thumbstud 30 to rotate the blade into the closed position.

Knife 10 also includes a locking mechanism that is movably secured to handle 12, typically near handle end 12*a*. The locking mechanism typically is movable between a retracted position and a locking position (also known as the extended position), in which it interacts with the protruding structure provided on the blade to lock the blade in the open position.

In the folding knife embodiment depicted in FIGS. 1 and 2, the locking mechanism includes a latch 32 movably secured to handle end 12*a* on one of sideplates 16 and 18. Latch 32 is movable in and out of an area partly bounded by latch recess 34 and coverplate 36, which are provided on the sideplate to which the latch is secured. Latch 32 is movable out of recess 34 into an extended or locking position, though typically the latch is at least partially retained within latch recess 34 even when in the extended position.

Latch 32 typically is configured so that, when moved into the extended position, the latch extends at least partly into path of travel P of the post 30. In this position, latch 32 obstructs movement of the post, as shown in FIG. 2, to prevent rotation of the blade and lock the blade in the open position. The latch and post preferably are configured so that the latch contacts or otherwise engages the post when the blade is in the open position. This eliminates play or wobble resulting from the blade moving slightly out of the open position.

Figure 3:
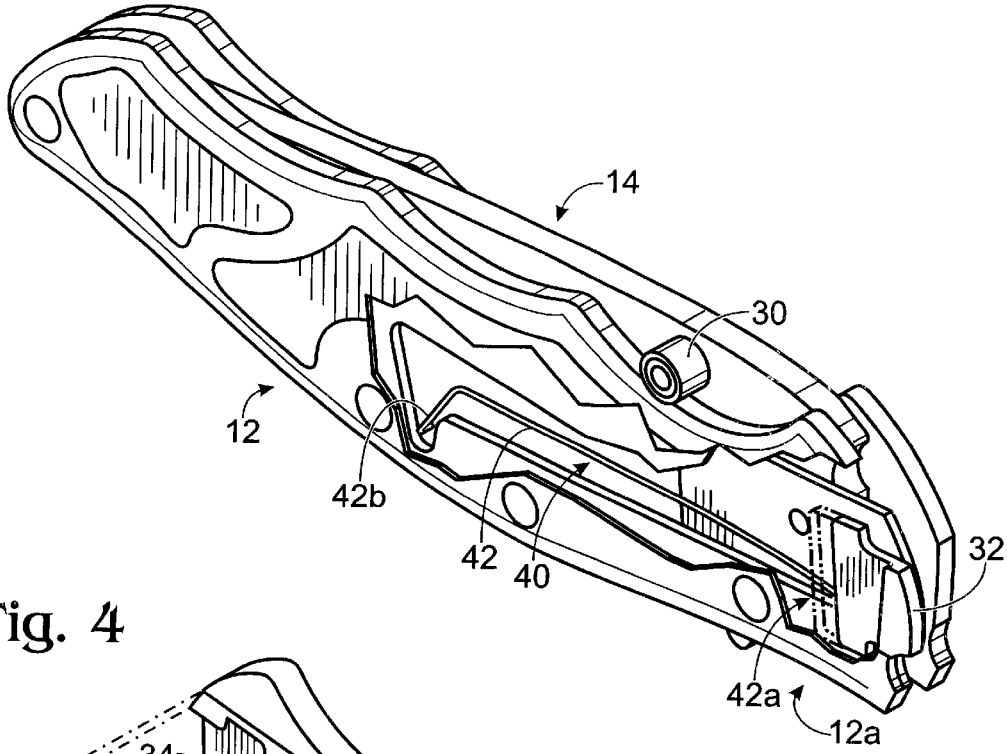
FIG. 3 is an isometric view of the knife shown in FIG. 1, with portions of the handle cut away to show the locking mechanism used to lock the blade in the open position.

Latch 32 may be biased toward, or into, the locking/extended position shown in FIG. 2. Typically, this is accomplished by some sort of spring assembly, such as plunger assembly 40, which is shown in FIGS. 3 and 4. Plunger assembly 40 biases latch 32 into the extended position and includes a bent wire latch spring 42 that is operatively connected between knife handle 12 and latch 32. Specifically, first end 42*a* (the "latch end") of the latch spring engages latch 32 and second end 42*b* (the "handle end") is received within hole 22*a* in backstrap 22.

Figure 7:
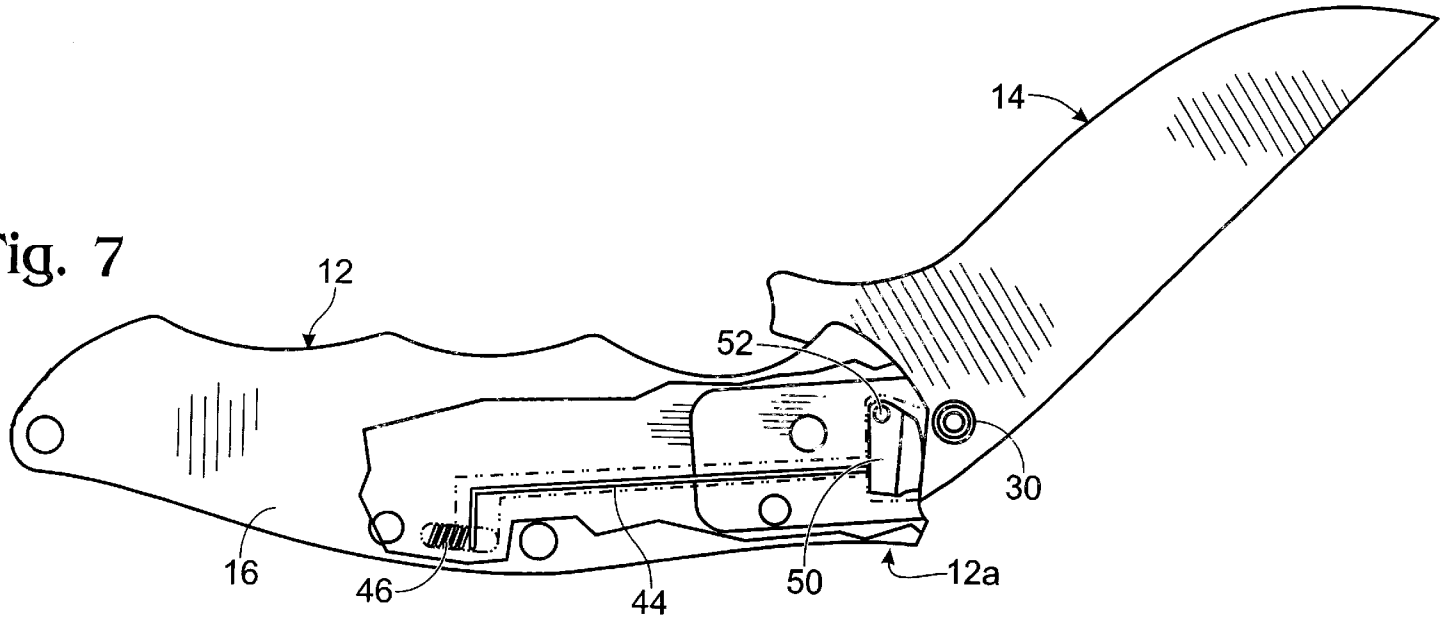
FIG. 7 is a side view of an alternate embodiment of a folding knife according to the present invention, depicting an alternately configured locking mechanism.
Figure 8:
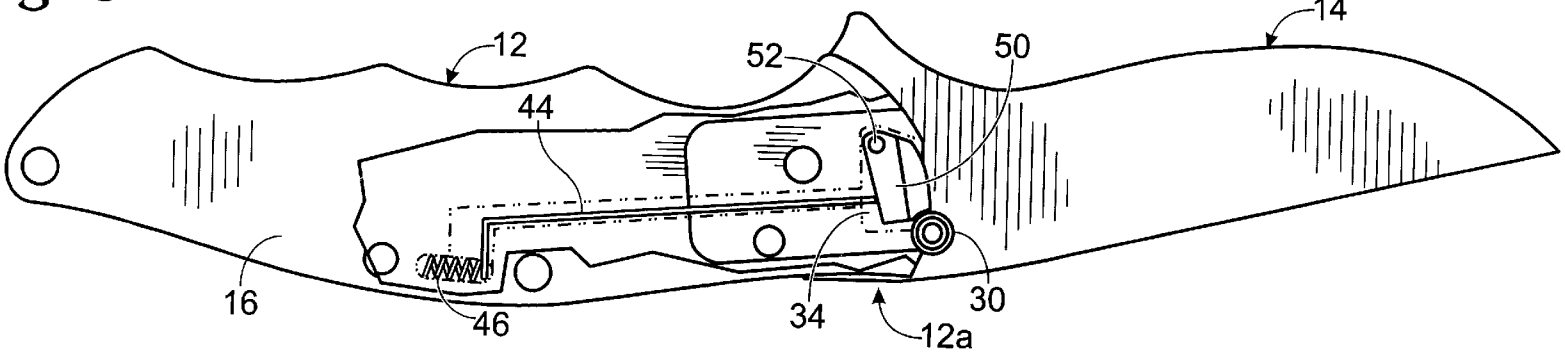
FIG. 8 is a side view of the knife shown in FIG. 7, depicting the blade locked in the open position.

Alternatively, the spring assembly may be configured with a wire plunger 44 connected to a coiled latch spring 46 that is held by the knife handle within a cavity in the backstrap, as shown in FIGS. 7 and 8. One end of wire plunger 44 contacts latch 32, while the opposite end of the plunger engages latch spring 46. Latch spring 46 resists compression to provide a biasing force that urges latch 32 into the extended locking position.

Figure 5:
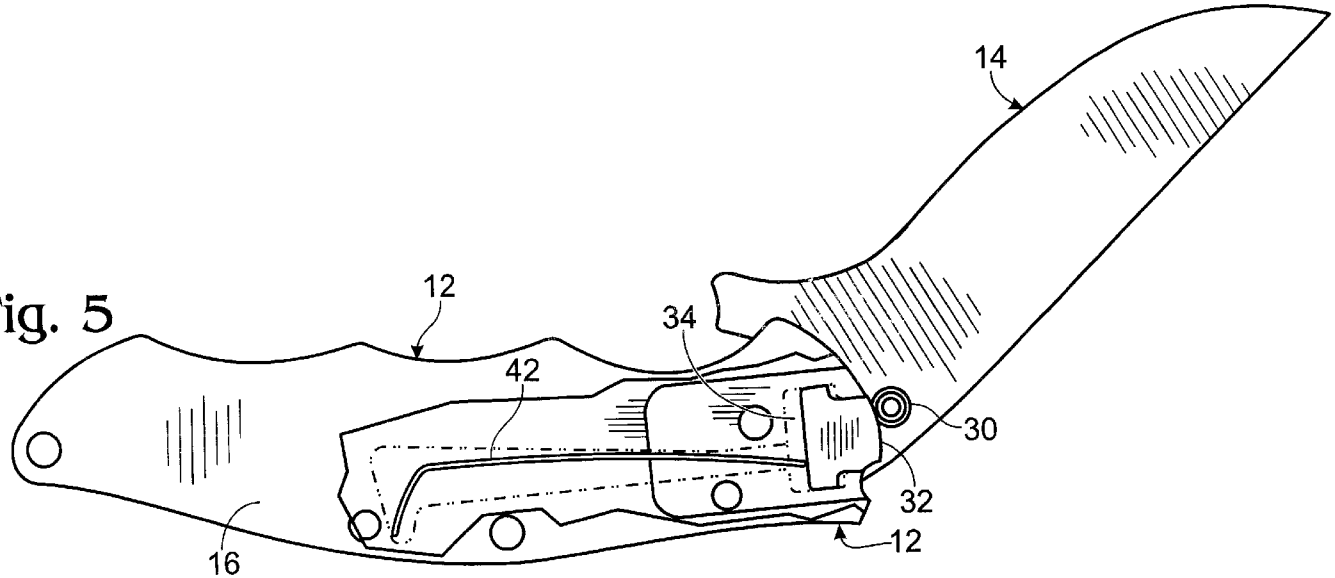
FIG. 5 is a side view of the knife shown in FIG. 1, depicting the blade moving toward the open position.
Figure 6:
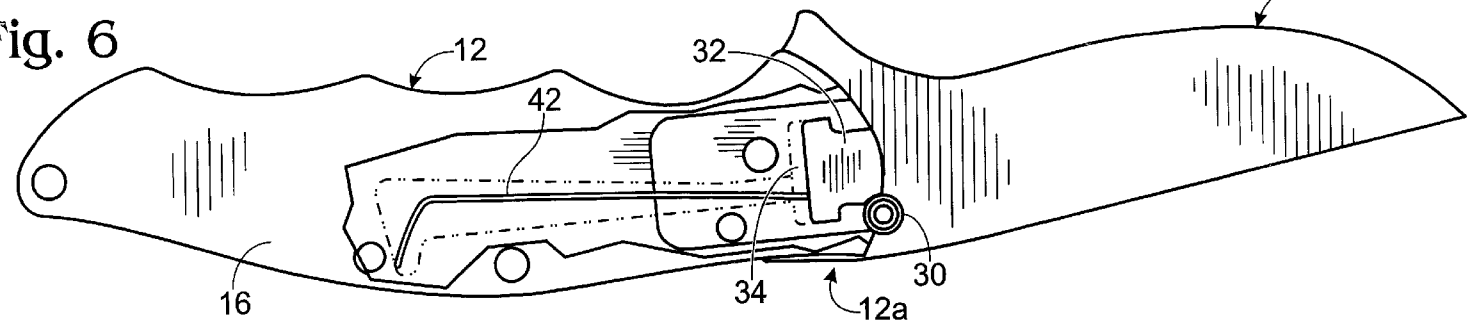
FIG. 6 is a side view of the knife shown in FIG. 5, depicting the blade locked in the open position.

As indicated above, post 30 contacts, engages or otherwise interacts with latch 32 as blade 14 is rotated between the closed and open positions. For example, folding knife 10 typically is configured so that, during an intermediate portion of the rotational range of the blade, post 30 contacts latch 32 and forces the latch into the latch recess. This is shown in FIG. 5. It will be appreciated that the spring cavity in which the latch spring is received is sized and shaped to allow the latch spring to compress and deform when latch 32 is pushed into latch recess 34. Typically, post 30 does not force latch 32 into recess 34 when blade 14 is fully rotated into either the open or closed position.

Preferably, post 30 and latch 32 are shaped so that, when extended, the latch permits rotational movement of the blade toward the open position, but does not permit rotation out of the open position. This typically is achieved by providing the outer portion of the latch with a cam-like profile that enables post 30 to "ride" onto latch 32 and force the latch downward into recess 34 when the blade is rotated from the closed position toward the open position.

By contrast, when the blade is in the open position, the extended latch presents a planar blocking surface to post 30 that is perpendicular to travel path P of the post. Therefore, the blade cannot be rotated out of the open position unless the latch is retracted from the extended position. As explained below, various alternatives exist for operating latch 32 and causing it to be retracted when the blade is to be unlocked and folded into the closed position.

In the embodiment shown in FIGS. 1–5, the latch moves in and out of the latch recess translationally, however the latch may be configured to pivot into and out of the latch recess. FIGS. 7 and 8 depict such a pivoting latch 50. FIG. 7 depicts latch 50 in both the retracted position (solid lines) and the extended position (dashed lines), while FIG. 8 depicts latch 50 in the extended locking position only. Latch 50 is secured to handle sideplate 16 using pivot pin 52, enabling the latch to pivot outward into the extended locking position shown in FIG. 8. In the extended position, the latch is still partially received within latch recess 34. As with the previously described latch configurations, latch 50 may be biased into the extended position using a spring or other biasing mechanism.

Figure 11:
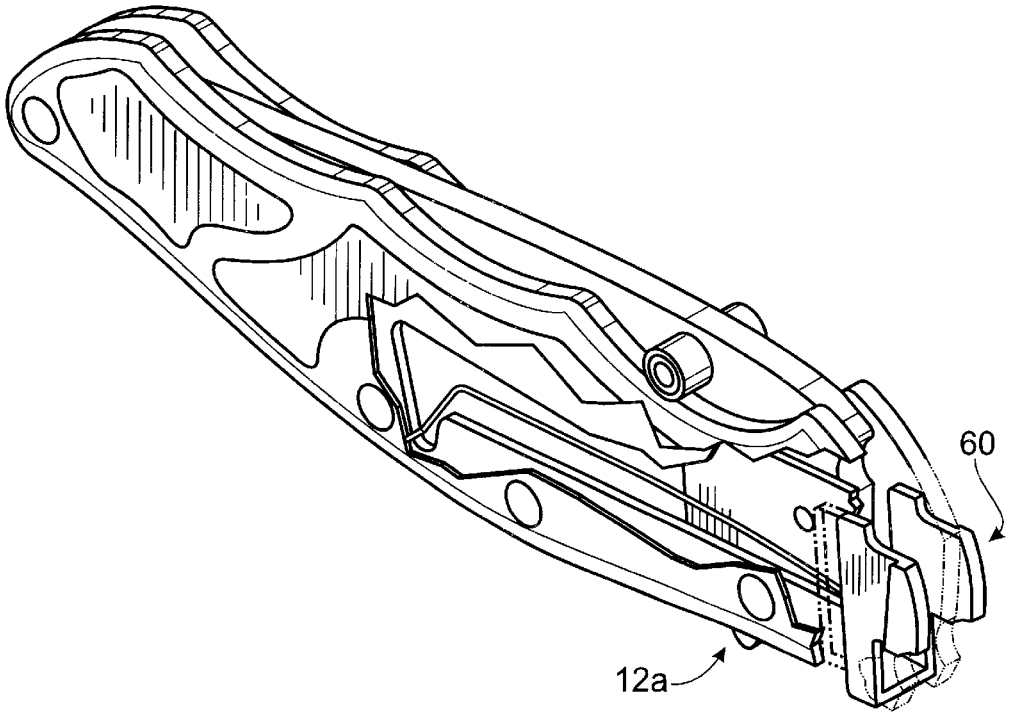
FIG. 11 is an isometric view of yet another alternate embodiment of a folding knife according to the present invention, depicting an alternately configured locking mechanism that interacts with, and is accessible from opposing sides of the knife handle.

As indicated above, the blade may be provided with a post that extends from both sides of the blade. The locking mechanism of the present invention may similarly be configured for operation on both sides of the blade. For example, latch 32 (FIGS. 1 and 2) may be modified in order to engage a thumb/locking post having portions extending from both sides of blade 14. FIG. 11 depicts such an alternately configured latch 60. Latch 60 includes all of the structural components of latch 32, but with various of those components duplicated on the other side of knife handle 12, including a latch recess, coverplate, and cam-like member configured to move into and out of the latch recess. In addition, a second biasing assembly may be provided to assist in biasing the entire latch assembly toward the extended/locking position. An advantage of the two-sided approach is that the design is symmetrical with respect to both sides of knife handle 12, enabling either right- or left-handed operation of the thumb post and locking mechanism.

Figure 9:
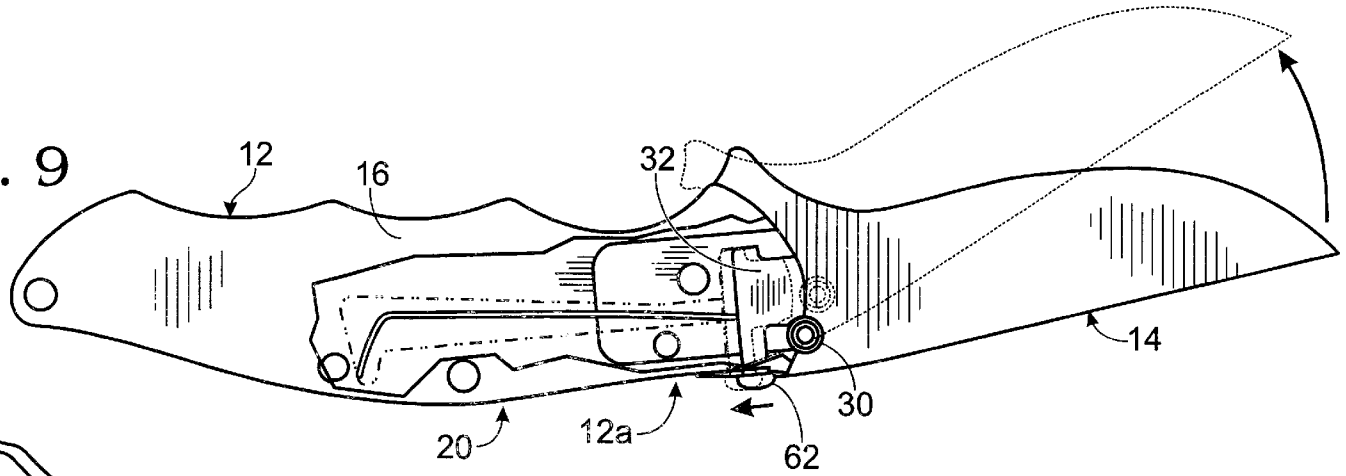
FIG. 9 is a side view of another alternate embodiment of a folding knife according to the present invention, depicting a blade locking mechanism with an actuating knob that is accessible from the back of the knife handle.
Figure 10:
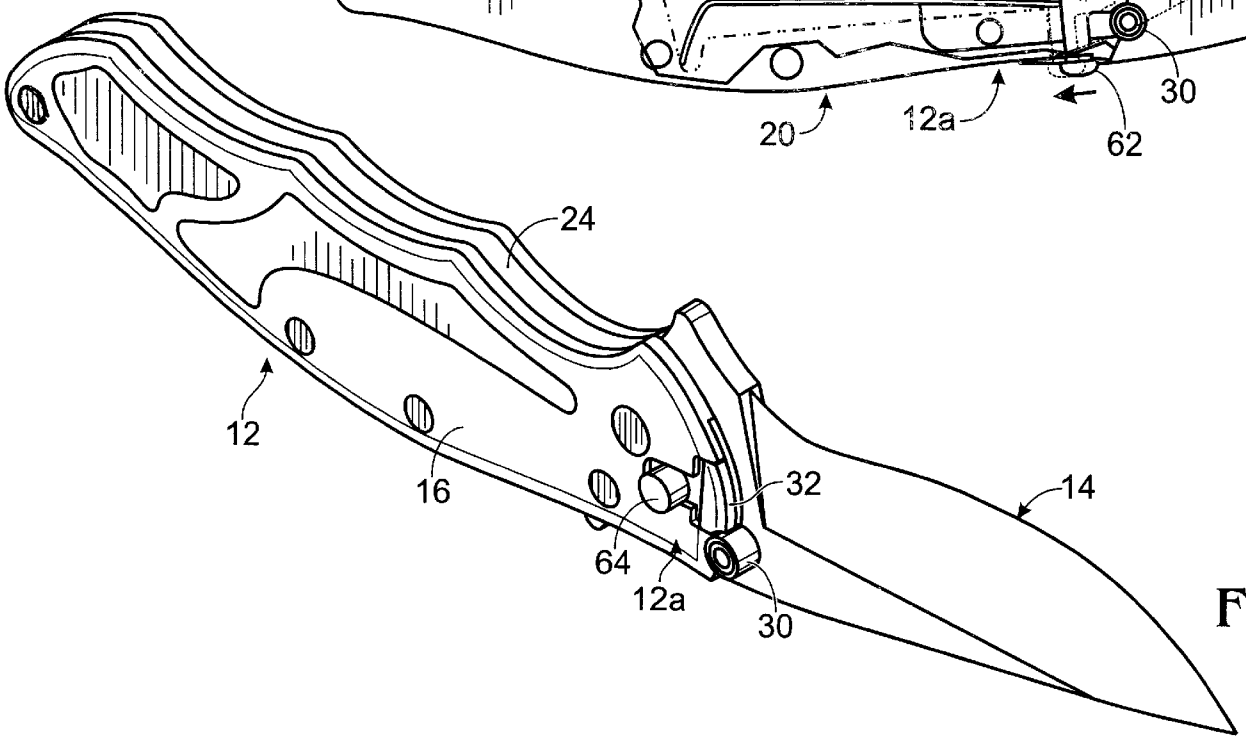
FIG. 10 is an isometric view of yet another alternate embodiment of a folding knife according to the present invention, depicting a blade locking mechanism with an actuating knob that is accessible from the side of the knife handle.

The locking latches described above are exposed to enable manual retraction of the latch with a user's thumb. For example, FIG. 12 depicts a user's hand 61 retracting the locking latch (not shown) to unlock blade 14 and fold it toward the closed position. Alternatively, a manual actuating mechanism may be operatively connected to the latch such that selectively operating the actuating mechanism causes the latch to be retracted from the extended locking position. For example, referring now to FIG. 9, knob 62 is operatively connected to latch 32 through a slot in back 20 of handle 12. Alternatively, an actuating knob 64 may be provided to extend out of a slot in the side of the knife handle, as shown in FIG. 10.

In addition to the various features discussed above, a blade spring may be provided to assist opening and/or closing of the knife blade. The blade spring is operatively connected between the blade and knife handle, and has one end secured to the blade and a second end held by a slot formed in the knife handle. Typically, the blade spring is configured to undergo maximum deformation (compression or tension) when the blade is pivoted to an equilibrium point between the open and closed positions. When the blade is pivoted to one side of the equilibrium point, the blade spring exerts a closing force upon the blade to urge it toward the closed position. On the other side of the equilibrium point, the spring exerts an opening force upon the blade.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

I claim:

1. A folding knife comprising:

a handle having a pivot shaft;

a blade movably secured to the handle so that the blade is rotatable about the pivot shaft between a closed position and an open position;

a post located on the blade and spaced apart from the pivot shaft, where the post moves along a path of travel when the blade is rotated about the pivot shaft; and a movable latch, where, when the blade is in the open position, the latch is movable into an extended position in which it extends into the path of travel of the post, to prevent the blade from moving from the open position toward the closed position.

2. The folding knife of claim 1, where the handle includes a latch recess for at least partially receiving the latch when it is retracted from the extended position.

3. The folding knife of claim 2, where the latch recess and latch are configured so that the latch is retained at least partially within the latch recess when the latch is in the extended position.

4. The folding knife of claim 1, further comprising a latch spring that biases the latch into the extended position.

5. The folding knife of claim 4, where:

the handle includes a pair of side members separated by a spacer;

the spacer includes a hole for receiving an end of the latch spring;

the knife includes a blade spring for assisting in rotating the blade from the closed position to the open position; and the spacer includes a slot for receiving an end of the blade spring.

6. A folding knife comprising:

a handle having a pivot shaft;

a blade movably secured to the handle so that the blade is rotatable about the pivot shaft between a closed position and an open position;

a post located on the blade, where the post moves along a path of travel when the blade is rotated about the pivot shaft;

a movable latch, where, when the blade is in the open position, the latch is movable into an extended position in which it extends into the path of travel of the post, to prevent the blade from moving from the open position toward the closed position; and a wire plunger and a coiled spring configured to bias the latch into the extended position.

7. The folding knife of claim 1, where the post includes two portions that respectively extend transversely from opposing sides of the blade, and where the latch is configured to extend into the path of travel of each of the two post portions.

8. The folding knife of claim 1, where the latch is accessible from both of two opposing sides of the handle, to allow a user to selectively retract the latch from the extended position.

9. The folding knife of claim 1, further comprising an actuating mechanism operatively connected to the latch through an opening provided in the handle of the knife, where selective movement of the actuating mechanism causes the latch to be retracted from the extended position.

10. The folding knife of claim 9, where the opening is provided in a side member of the handle, and where the actuating mechanism includes a knob protruding through the opening.

11. The folding knife of claim 9, where the opening is provided in a back of the handle, and where the actuating mechanism includes a knob protruding through the opening.

12. A folding knife, comprising:

a blade pivotally connected to an end of a handle so that the blade is rotatable about a pivot axis between an open position in which the blade is extended away from the handle and a closed position in which the blade is at least partially received within the handle; and a locking mechanism secured to the handle and movable into a locking position in which the locking mechanism blocks a protruding member that is spaced apart from the pivot axis and that extends outward from a surface of the blade to prevent the blade from being rotated from the open position to the closed position.

13. The folding knife of claim 12, where the locking mechanism is biased into the locking position.

14. The folding knife of claim 13, further comprising a spring that biases the locking mechanism into the locking position.

15. The folding knife of claim 12, where the locking mechanism permits rotation of the blade toward the open position but prevents rotation of the blade from the open position toward the closed position.

16. The folding knife of claim 12, where the locking mechanism is located in an exposed position to enable a user to manually retract the locking mechanism from the locking position.

17. The folding knife of claim 12, where the protruding member includes a post extending transversely from the blade.

18. The folding knife of claim 12, where the protruding member is spaced from the pivot axis such that the protruding member follows an arcuate path when the blade is pivoted relative to the handle.

19. The folding knife of claim 12, where the locking mechanism includes a latch movably secured to the end of the handle to which the blade is attached, the latch being located in an exposed location to enable a user to manually operate the latch.

20. The folding knife of claim 12, where the locking mechanism is retractable into a recess in the handle near the end of the handle to which the blade is attached.

21. A folding knife comprising:

a handle;

a blade pivotably secured to an end of the handle with a pintle so that the blade is pivotable between a closed position in which the blade is received at least partially within the handle and an open position in which the blade extends away from the handle;

a post located on the blade adjacent to and spaced-apart from the pintle; and a latch movably secured to the handle, where:

the post and latch are configured so that the post pushes the latch into a retracted position as the blade rotates from the closed position to the open position and permits the latch to return to a locking position when the blade is fully rotated to the open position; and the latch is biased into the locking position, in which the latch interacts with the post to lock the blade in the open position.

22. The folding knife of claim 21, further comprising a latch recess in the handle so that the latch is movable into and out of the handle.

23. The folding knife of claim 22, where the latch recess and the latch are configured so that the latch is at least partially retained within the recess when the latch is in the locking position.

24. A folding knife comprising:

a handle;

a blade pivotably secured to an end of the handle with a pintle so that the blade is pivotable between a closed position in which the blade is received at least partially within the handle and an open position in which the blade extends away from the handle;

a post located on the blade adjacent to the pintle;

a latch movably secured to the handle; and a latch pivot pin about which the latch is pivotable at least partially into and out of the handle, where:

the post and latch are configured so that the post pushes the latch into a retracted position as the blade rotates from the closed position to the open position and permits the latch to return to a locking position when the blade is fully rotated to the open position; and the latch is biased into the locking position, in which the latch interacts with the post to lock the blade in the open position.

25. The folding knife of claim 24, further comprising a latch recess in the handle so that the latch is pivotable at least partially into the handle.

26. The folding knife of claim 21, further comprising a spring that biases the latch into the locking position.

27. The folding knife of claim 21, further comprising a wire plunger and a coiled spring to bias the latch into the locking position.

28. The folding knife of claim 21, where the post includes two portions that respectively extend transversely from opposing sides of the blade, and where the latch is configured to interact with both post portions to lock the blade in the open position.

29. The folding knife of claim 21, where the latch is retractable from the locking position by accessing and operating the latch from either of two opposing sides of the handle.

30. The folding knife of claim 21, further comprising an actuating mechanism operatively connected to the latch through an opening provided in the handle of the knife, where selective movement of the actuating mechanism causes the latch to be retracted from the locking position.

31. The folding knife of claim 21, where the opening is provided in a side member of the handle, and where the actuating mechanism includes an actuating knob protruding through the opening.

32. The folding knife of claim 21, where the opening is provided in a back of the handle, and where the actuating mechanism includes an actuating knob protruding through the opening.

* * * * *

UNITED STATES PATENT AND TRADEMARK OFFICE

CERTIFICATE OF CORRECTION

PATENT NO. : 6,427,334 B2
DATED : August 6, 2002
INVENTOR(S) : Kenneth J. Onion

It is certified that error appears in the above-identified patent and that said Letters Patent is hereby corrected as shown below:

Title page,
Item [22], should read: -- [22] Filed: Dec. 27, 2000 --

Signed and Sealed this

Eleventh Day of February, 2003

JAMES E. ROGAN
*Director of the United States Patent and Trademark Office*